US005172777A

United States Patent [19]

Siracki et al.

[11] Patent Number: 5,172,777

[45] Date of Patent: Dec. 22, 1992

[54] INCLINED CHISEL INSERTS FOR ROCK BITS

[75] Inventors: Michael A. Siracki, Spring, Tex.; James C. Minikus, Costa Mesa, Calif.

[73] Assignee: Smith International, Inc., Houston, Tex.

[21] Appl. No.: 766,882

[22] Filed: Sep. 26, 1991

[51] Int. Cl.[5] ..... E21B 10/16; E21B 10/52

[52] U.S. Cl. ..... 175/374; 175/430; 175/431

[58] Field of Search ..... 175/426, 427, 428, 431, 175/374

[56] References Cited

U.S. PATENT DOCUMENTS

| | | | |
|---|---|---|---|
| 3,442,342 | 5/1969 | McElya et al. | 175/374 |
| 3,599,737 | 8/1971 | Fischer | 175/426 |
| 4,058,177 | 11/1977 | Langford, Jr. et al. | 175/374 |
| 4,086,973 | 5/1978 | Keller et al. | 175/374 |
| 4,334,586 | 6/1982 | Schumacher | 175/426 X |
| 4,406,337 | 9/1983 | Dill | 175/374 X |
| 4,832,139 | 5/1989 | Minikus et al. | 175/374 |

*Primary Examiner*—Stephen J. Novosad
*Attorney, Agent, or Firm*—Robert M. Vargo

[57] ABSTRACT

A chisel gage insert is disclosed having a larger nose radius at the outer end of the insert crest than at the inner end thereby providing more mass on the portion of the insert that contacts the borehole sidewall. The rounded crest also blends with the convex surfaces of the insert extension so as not to have any non-tangential intersections.

6 Claims, 3 Drawing Sheets

INCLINED CHISEL INSERTS FOR ROCK BITS

BACKGROUND OF THE INVENTION

I Field of the Invention

This invention relates generally to rotary cone rock bits having hard metal cutter inserts mounted on the rotary cones, and more specifically to chisel type inserts used particularly on the gage row of each cone.

II Description of the Prior Art

There are a number of prior art patents that disclose chisel inserts used on the gage row of rock bit cones. For example, U.S. Pat. No. 3,442,342 discloses a gage insert having flats ground thereon to the precise gage diameter of the borehole. FIGS. 15 and 16 of the patent show such an insert that is illustrated in FIGS. 1–4 of the present specification. As described, these flats provide a relatively large contact area against the borehole sides. However, the problem with such inserts is that the large contact areas are susceptible to heat checking, resulting in premature wear and breakage. Insert heat checking can be defined as high cycle thermal fatigue due to intermittent frictional heat generated by borehole wall to gage insert contact and subsequent cooling by drilling fluid per each revolution.

U.S. Pat. No. 4,832,139 shows an inclined chisel insert having different cone angles on opposite sides of the crest. The advantage of such an insert is that it provides a relatively small area of contact with the borehole wall thereby being less prone to frictional heating.

Another type of insert is shown in U.S. Pat. No. 4,086,973. Although this insert is not a gage insert, it does show an inclined crest positioned to contact the formations with substantially its entire length.

All of the above cited inserts are designed with a constant radius joining the crest and the flanks. This leaves a flat on top of the insert to do some cutting when the flanks of an insert have no common plane perpendicular to both. This flat is not optimal as the constant radius that joins the flat to the flanks is an area of high stress concentration.

However, when the flanks of the insert have a common plane perpendicular to them both, the end of the crest that cuts the hole wall generally tends to wear quickly due to the reduced volume of insert material in that region.

These prior art designs also had equal outer and inner corner radii extending beyond the ends of the crests. This type of structure causes the outer ends of the inserts to wear faster than otherwise desirable, therefore leading to premature undergage conditions.

SUMMARY OF THE INVENTION

The present invention obviates the above mentioned shortcomings by providing a chisel insert having a larger nose radius at the outer end of the insert crest than at the inner end. This provides more mass on the portion of the insert that contacts the borehole sidewall.

The chisel insert of the present invention also has a larger outer corner radius than the inner corner, thereby decreasing the rate of insert wear on the gage.

Thus the larger nose and corner radii at the outer end of the insert, greatly increases insert life and reduces bit undergage conditions. In addition, there is a minimal rate of penetration decrease because of the smaller nose and corner radii at the inner end.

An embodiment of the present invention also includes an insert having front and back conical surfaces of different angles.

Another embodiment of the present invention includes an inclined crest which also cooperates with the conical surface of the insert extension to create a larger outer nose and corner radius on the insert.

This allows the insert tip extension to be increased without increasing the hole wall contact end. Increasing the tip extension at the hole wall contacting end generally requires insert relocation and/or more of a reaming type formation removal that is more stressful to the insert.

Still another embodiment of the present invention can be constructed so that the rounded crest can blend with the convex surface of the insert extension so as not to have any non-tangential intersections.

The above noted objects and advantages of the present invention will be more fully understood upon a study of the following description in conjunction with the detailed drawings.

Figure 1:
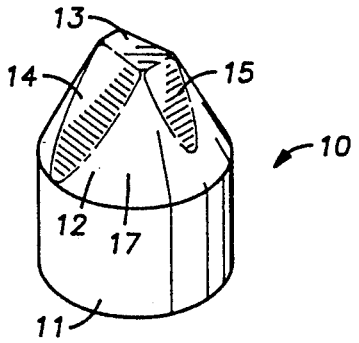
FIG. 1 (PRIOR ART)
FIG. 1 is a perspective view of a prior art wedge crested chisel insert.
Figure 2:
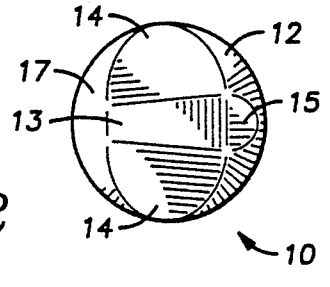
FIG. 2 (PRIOR ART)
FIG. 2 is a top elevational view of the prior art insert.
Figure 3:
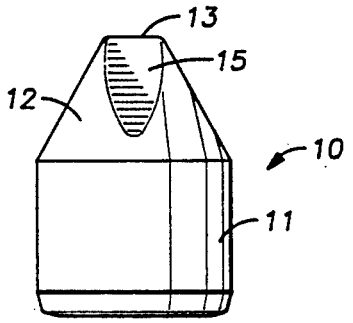
FIG. 3 (PRIOR ART)
FIG. 3 is a right side elevational view of the prior art insert.
Figure 4:
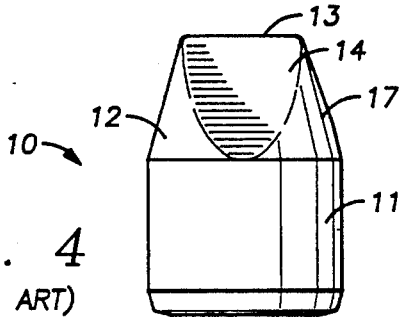
FIG. 4 (PRIOR ART)
FIG. 4 is a front elevational view of the prior art insert.
Figure 5:
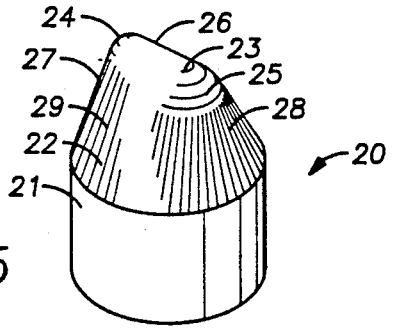
FIG. 5 is a perspective view of a wedge crested inclined chisel insert of the present invention.
Figure 6:
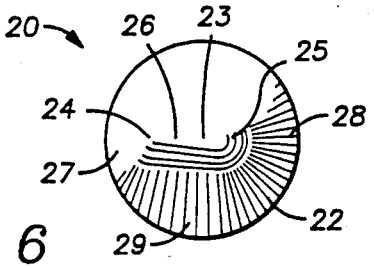
FIG. 6 is a top elevational view of the chisel insert of the present invention.
Figure 7:
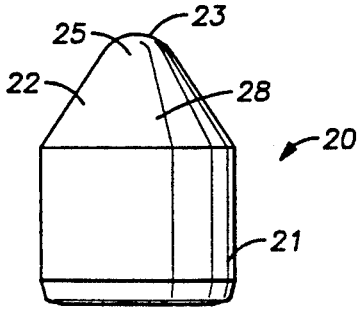
FIG. 7 is a side elevational view of the chisel insert of the present invention.
Figure 8:
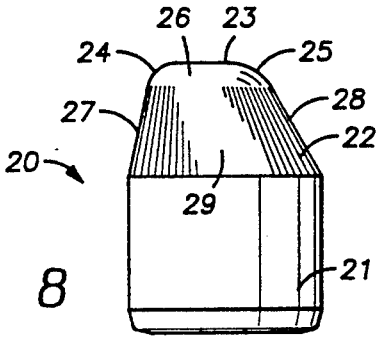
FIG. 8 is a side elevational view of the chisel insert of the present invention.

DETAILED DESCRIPTION OF THE PREFERRED EMBODIMENTS AND BEST MODE FOR CARRYING OUT THE INVENTION

FIGS. 1–4 illustrate a prior art chisel insert 10 used on the gage row of rock bit cones. The insert 10 includes a cylindrical base 11 which is adapted to extend into a hole formed in the cone to be supported thereby. The insert 10 also includes an extension or cutting tip 12 which is adapted to extend above the surface of the cone.

The cutting tip 12 of insert 10 has at its outermost extremity a crest 13 and a pair of flanks 14 generally converging toward the crest. A small flat 15 is ground on the surface of the insert 10 as illustrated. The top of the crest 13 is substantially flat and is only slightly rounded at its edges to eliminate the sharpness of the intersections.

The balance of the cutting tip 12 is a conical surface 17 symmetric about the insert axis.

FIGS. 5–8 illustrate the first embodiment of the present invention comprising a wedge crest inclined chisel insert, generally indicated by arrow 20. The insert 20 includes a cylindrical base 21 centered about the axis of the insert. It should be noted that the base 21 is made in cylindrical form largely because it is the most practical. Other forms of sockets could be formed, but since it is more economical to drill circular holes in the cone for receiving the base portion of the insert, cylindrical insert bases are preferred.

The insert 20 further includes a cutting tip 22 which is adapted to extend out of the surface of the cone. The cutting tip 22 has its outermost extremity forming a wedge shaped crest 23 having ends 24 and 25. End 24 is formed by a radius extending therearound and is adapted to be oriented on the cone to face inwardly away from the hole wall surface. End 25 is formed by a larger radius than that of end 24 to form a larger mass at that end and is adapted to be oriented on the gage row of the cone to face and engage the hole wall surface.

The remaining portion 26 of crest 23 is tapered from the large radiused end 25 down to the small radiused end 24 and is formed by constantly descending radii extending from a radius equalling that at the end 25 to a radius equalling that at end 24.

The cutting tip 22 further includes a pair of convex surfaces 27 and 28 formed at the opposite ends of the crest 23. The convex surface 27 has a steeper angle than convex surface 28. Preferably, these angles are 14° and 28° respectively. The convex surface 28 is adapted to be oriented to face and engage the hole wall surface. The steeper angle of the convex surface 27 enables the crest 23 to remain as long as conventional insert crests while still providing the desired gage surface angle.

The remaining surface 29 is completed by contouring the wedged shaped crest with the base. In fact, the entire cutting surface of the cutting tip 22 has no non-tangential intersections and is made in accordance with the teaching made in Assignee's copending application Ser. No. 744,777.

Figure 9:
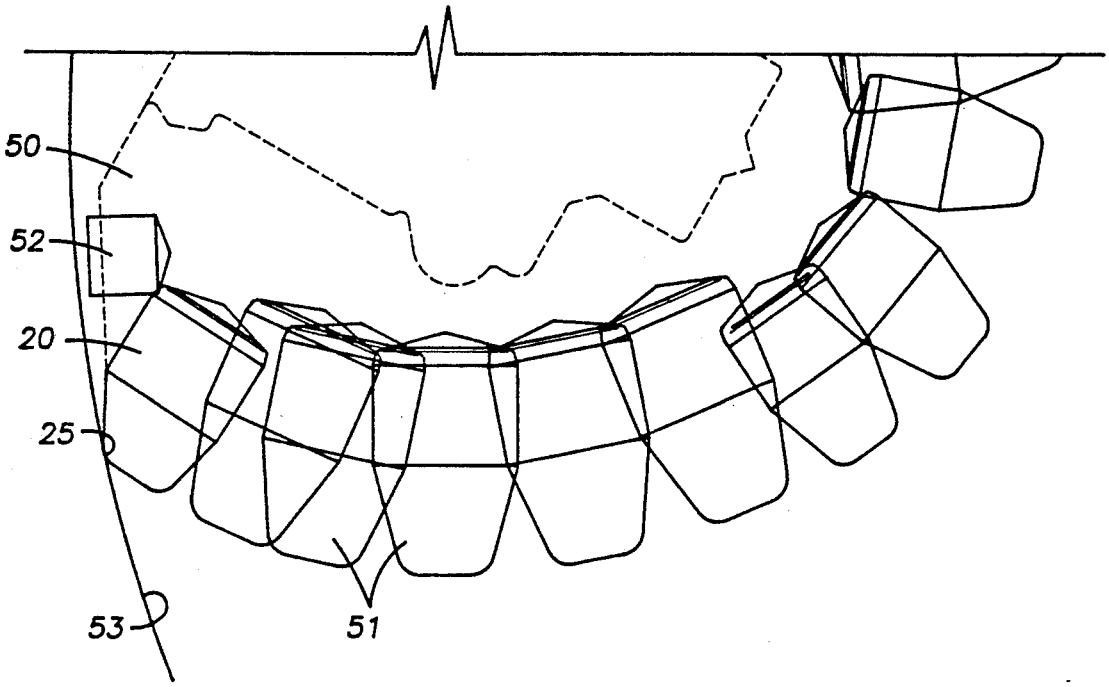
FIG. 9 is a bottom hole profile of a rock bit utilizing the chisel insert of the present invention.
Figure 10:
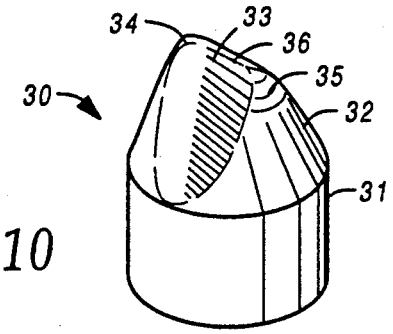
FIG. 10 is an elevational view of a second embodiment of the present invention.
Figure 11:
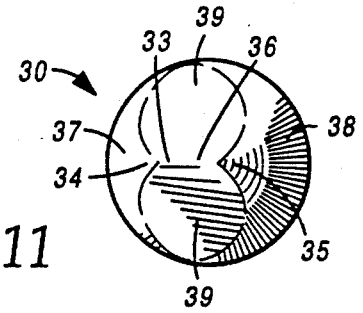
FIG. 11 is a top elevational view of the second embodiment.
Figure 12:
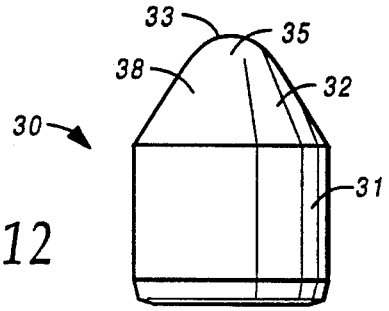
FIG. 12 is a side elevational view of the second embodiment.
Figure 13:
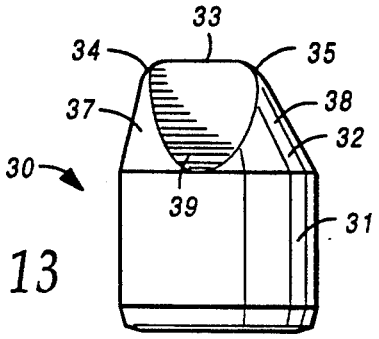
FIG. 13 is a front elevational view of the second embodiment.
Figure 14:
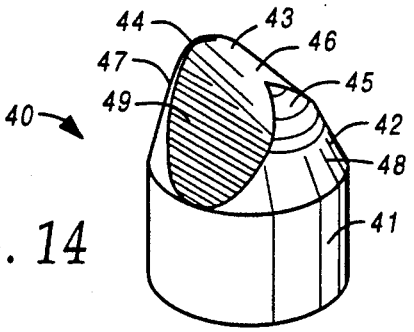
FIG. 14 is an elevational view of a third embodiment of the present invention.
Figure 15:
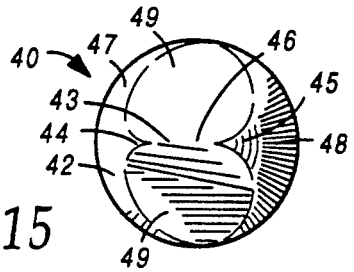
FIG. 15 is a top elevational view of the third embodiment.
Figure 16:
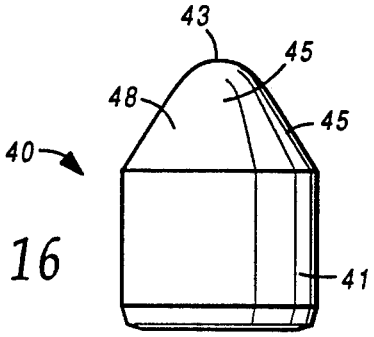
FIG. 16 is a side elevational view of the third embodiment.
Figure 17:
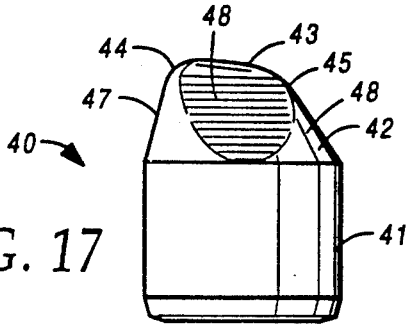
FIG. 17 is a front elevational view of the third embodiment.

FIG. 9 illustrates the bottom hole rock bit profile showing the location of the chisel insert 20 being on the gage row of a cone 50. As is conventional, all of the inner rows of inserts 51 from all three cones are superimposed on the figure and in no way form any part of the present invention. The cone 50 also conventionally includes a plurality of heel row inserts 52 located thereon.

As can be seen, the insert 10 is oriented to have the enlarged radiused end 25 of the crest 23 contact the borehole wall surface 53. The enlarged end is typically about 50% larger than the inner end radius. As the insert wears, the crest length is reduced but still adequate to support the insert at an advanced state of wear. The additional mass of material located at that end enables the insert to wear more slowly. In addition, the enlarged radiused end 25 functions to reduce the stress level acting thereon to prevent the inserts from cracking or chipping.

FIGS. 10–13 illustrate the second embodiment of the present invention comprising a wedge crest inclined chisel insert generally indicated by arrow 30. This embodiment is similar to the insert described in Assignee's U.S. Pat. No. 4,832,139, with the exception that the crest of the present invention is tapered.

The insert 30 comprises a cylindrical base 31 and a cutting tip portion 32. The outermost extremity of the cutting tip 32 forms a crest 33 that is substantially similar to the crest 23 of the first embodiment.

The crest 33 includes a small radiused end 34 and a larger radiused end 35 that are adapted to be oriented in the same manner as ends 24 and 25. The portion of the crest between the ends is similarly tapered at 36.

The cutting tip 32 further includes a pair of conical surfaces 37 and 38 formed at opposite ends of the crest 33 with the conical surface 37 having a steeper cone angle than conical surface 38. The conical surface 37 is adapted to be oriented inwardly, away from the bore hole wall while the conical surface 38 is adapted to be oriented to face and engage the borehole wall surface.

A pair of flanks 39 are formed between the conical surfaces 37 and 38 and extend between the crest 33 and down to the base 31. The flanks 39 are substantially flat.

FIGS. 14–17 illustrate the third embodiment of the present invention comprising a wedge crest inclined chisel insert generally indicated by arrow 40. This embodiment is similar to the second embodiment with the exception that the crest is inclined rather than being horizontal.

The insert 40 includes a base 41 and a cutting end 42. The outermost extremity of the cutting tip 42 forms a crest 43 having an elevated inner end 44 and a relatively lower outer end 45. The crest 43 is again tapered along 46.

Like the other embodiments, the insert 40 is inclined by having a steeper conical surface 47 and borehole wall engaging conical surface 48. A pair of flanks 49 are also being formed on the cutting end 42 between the conical surface 47 and 48.

The crest 43 is radiused the same as the crests of the other embodiments and because the crest 43 is tilted downwardly to intersect the plane of the conical end 48 at a lower point than the others, it naturally tapers outwardly as it approaches that end.

As a result, all three embodiments provide an inclined chisel insert having a tapering crest that adds wear material at the area where it is needed most, and deletes material where it is not needed to maintain sharpness. These crests are also all rounded and radiused across their entire lengths to reduce the stress levels throughout.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A gage insert for a rolling cone rock bit having inner rows of inserts and a gage row of inserts, each gage insert comprising a base section and a cutting tip section, said base section being generally cylindrical and is adapted to extend into a matching hole formed on the gage row of the bit cone, the upper end of the cutting tip section, furthest away from the base section, comprises an elongated crest, having a first end which is adapted to be oriented toward the inner rows of inserts, and a second end which is adapted to be oriented toward the borehole wall surface, the remainder of the cutting tip surface below the crest being formed with an outer surface adjoining both the crest and base section, the elongated crest having a rounded convex exterior surface with the second end having a larger radius than the first end.

2. The invention of claim 1 wherein the remainder of the cutting tip section comprises a convex surface section under each end of the crest, the convex surface section under the first end having a steeper angle than the convex surface section under the second end.

3. The invention of claim 1 wherein the elongated crest is substantially normal to the cylindrical axis of the base section.

4. The invention of claim 1 wherein the elongated crest extends at an acute angle to the axis of the base section, whereby the crest is inclined so that the first end is higher than the second end.

5. The invention of claim 2 wherein the remainder of the cutting tip section further comprises a pair of flanks extending downwardly from the elongated crest between the convex surface sections.

6. The invention of claim 2 wherein the two convex surfaces of the cutting tip section extends downwardly from the elongated crest to the base section, said convex surfaces having no non-tangential intersections with the crest and the base section.

* * * * *